US007674141B2

(12) United States Patent
Canteri

(10) Patent No.: US 7,674,141 B2
(45) Date of Patent: Mar. 9, 2010

(54) TERMINAL FOR A CONNECTOR AND A CONNECTOR

(75) Inventor: Henry Charles Canteri, Braganca Paulista-S.P. (BR)

(73) Assignee: Tyco Electronics Brasil Ltda., Sao Paulo (BR)

( * ) Notice: Subject to any disclaimer, the term of this patent is extended or adjusted under 35 U.S.C. 154(b) by 0 days.

(21) Appl. No.: 12/159,819

(22) PCT Filed: Jan. 2, 2007

(86) PCT No.: PCT/BR2007/000001

§ 371 (c)(1),
(2), (4) Date: Jul. 1, 2008

(87) PCT Pub. No.: WO2007/076586

PCT Pub. Date: Jul. 12, 2007

(65) Prior Publication Data

US 2008/0287012 A1 Nov. 20, 2008

(30) Foreign Application Priority Data

Jan. 3, 2006 (BR) ..... 0600008

(51) Int. Cl.
*H01R 13/11* (2006.01)

(52) U.S. Cl. ..... 439/856

(58) Field of Classification Search ..... 439/856, 439/857, 290, 288, 287, 746; 24/370
See application file for complete search history.

(56) References Cited

U.S. PATENT DOCUMENTS 2,744,244 A * 5/1956 Folkenroth et al. ..... 439/290
6,186,821 B1 * 2/2001 Mullen, Jr. ..... 439/409

* cited by examiner

*Primary Examiner*—Alexander Gilman

(57) ABSTRACT

A connector includes a pair of terminals. Each of the terminals includes a housing and a connecting portion. The connecting portion is arranged in the housing. The connecting portion has a first end provided with a connecting member for connection of an electrical cable and a second end provided with a first blade and second blade arranged side by side. The first blade has a fitting arrangement and the second blade having a spring arrangement. The fitting arrangements of the first blades of the terminals are engaged to mate the terminals.

20 Claims, 3 Drawing Sheets

TERMINAL FOR A CONNECTOR AND A CONNECTOR

CROSS-REFERENCE TO RELATED APPLICATIONS

This application claims the benefit of the filing date under 35 U.S.C. § 120 of International Patent Application No. PCT/BR2007/000001 filed Jan. 2, 2007 which claims the priority of Brazil Patent Application No. PI 0600008-8 filed Jan. 3, 2006.

FIELD OF THE INVENTION

The present invention relates to a connector, particularly to an electric cable connector that consists of the junction of two terminals. The invention also relates to the respective terminals used in the connector.

BACKGROUND

As is generally known, the prior art connectors are made up of a male terminal fitted into a female terminal. One of the drawbacks of the prior art connectors is that they require multiple different components, since the male terminal components are all structurally different from the female terminal components. This entails higher costs, due to the variety of components, a higher need for manufacturing tools, a longer manufacturing and assembly time and doubled quantities in stock due to the use of male and female connectors.

Another drawback is that, after some time of usage, gaps arise between the components of both terminals, which causes a poor contact in the connector and, as a consequence, a momentary interruption in the electric power supply. Depending on the equipment being powered, such as a computer, for example, the interruption in the electric current may have very negative consequences.

SUMMARY

The objectives of the present invention are to provide a low cost and a higher operating safety connector.

Such objectives are achieved by a terminal for a connector comprising a housing and a connecting portion arranged in the housing. The connecting portion has a first end provided with a connecting member for connection of an electrical cable and a second end provided with a first blade and second blade arranged side by side. The first blade has a fitting arrangement, and the second blade has a spring arrangement.

Such objectives are further achieved by a connector comprising a pair of terminals. Each of the terminals includes a housing and a connecting portion. The connecting portion is arranged in the housing. The connecting portion has a first end provided with a connecting member for connection of an electrical cable and a second end provided with a first blade and second blade arranged side by side. The first blade has a fitting arrangement and the second blade having a spring arrangement. The fitting arrangements of the first blades of the terminals are engaged to mate the terminals. Thus, the connector according to the invention provides the advantage that both terminals are identical, having simultaneously a male and a female arrangement. Another advantage of the connector according to the invention is that it has a lesser amount and variety of components than the prior art connectors. Such a fact substantially reduces the manufacturing costs, since the manufacturing tools are simpler and the amount of material and assembly time are reduced. Another advantage of the connector according to the invention is that it provides a higher operating safety than the prior art connectors. Another advantage of the connector according to the invention is that the stock control is much simpler, since there are not male connectors and female connectors as in the prior art, but only connectors of the same type.

DETAILED DESCRIPTION OF THE EMBODIMENT(S)

Figure 1:
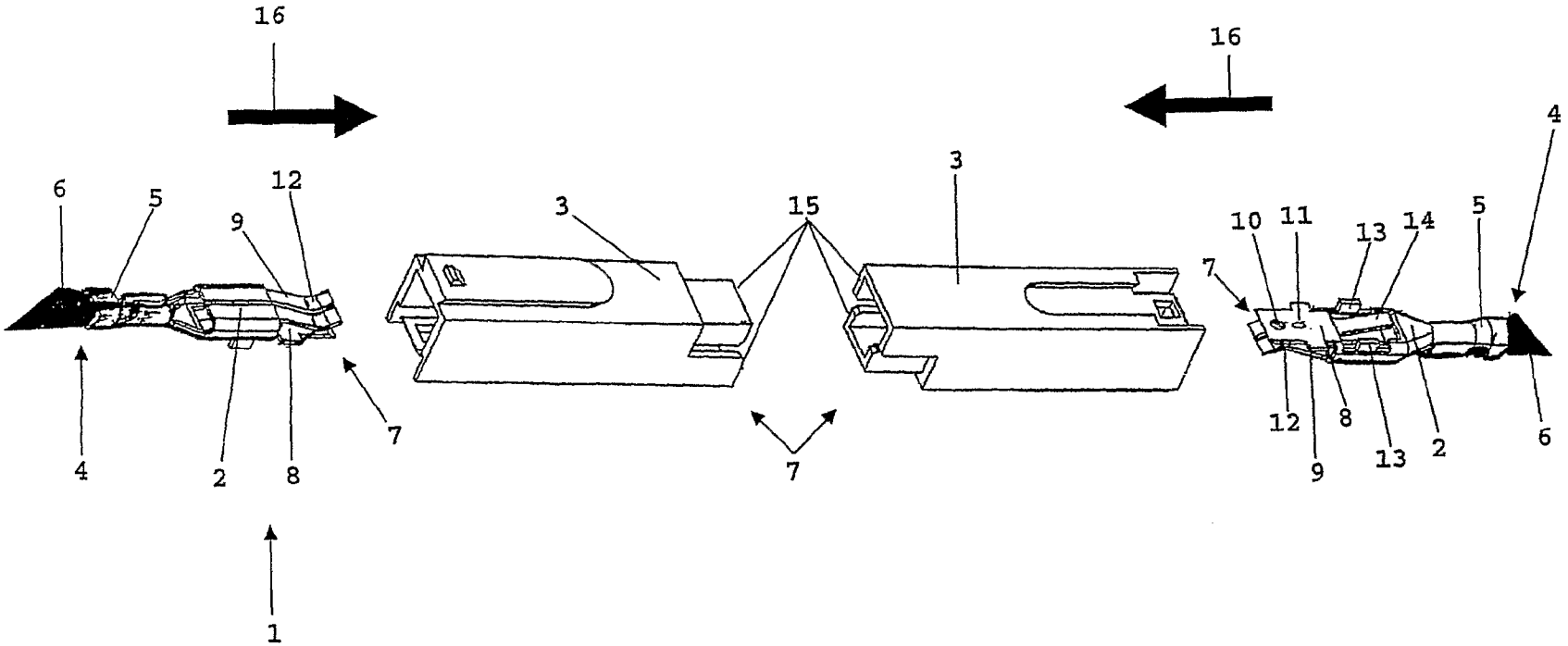
FIG. 1 is an exploded view of a preferred embodiment of the connector according to the invention.

FIG. 1 shows an exploded view of a preferred embodiment of a connector according to the invention, wherein two terminals 1 are seen which are comprised each of a connecting portion 2 and a housing 3. At a first end 4 of the terminal 1, the connecting portion 2 has a connecting member 5 for the connection of an electric cable 6, and, at a second end 7, the connecting portion 2 has two side by side electric contact blades (first blade 8 and second blade 9). The first blade 8 has an opening 10 and a projection 11, while the second blade 9 has an inclined portion 12 that provides a spring action. At the terminal 1 shown to the left in FIG. 1, one cannot see the opening 10 and projection 11 of the first blade 8, because the terminal 1 is inverted and the first blade 8 is at the bottom.

One can also see in the Figure that the connecting portion 2 has guides 13 for mounting onto the housing 3 and a tongue 14 for snap fitting into the housing 3; and that the second blade 9 is comprised of two legs, thereby forming a groove between them. However, the second blade 9 could be of one piece, that is, the two legs are unnecessary and are shown in the Figure only because of the terminal manufacturing process. The housing 3 has, at the second end 7 of the terminal 1, a sliding arrangement 15.

Figure 2:
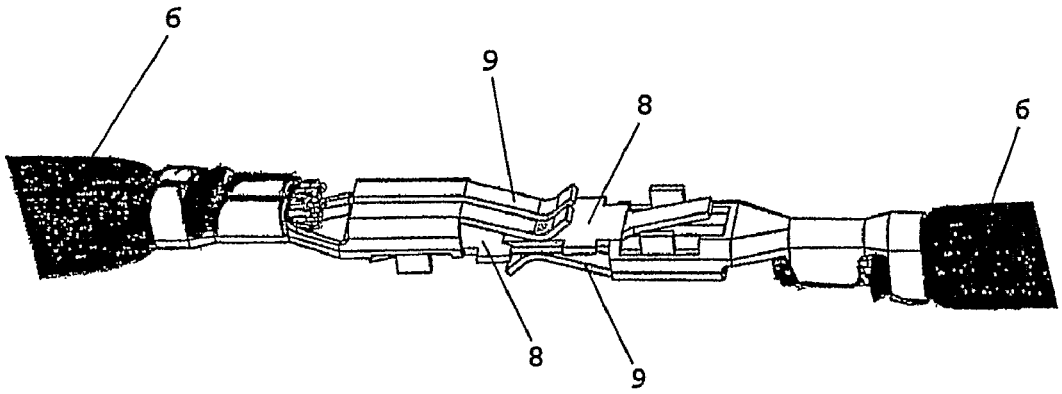
FIG. 2 is a view of the connector of FIG. 1, without the housings.

FIG. 2 shows a view of the connector of FIG. 1 wherein the two terminals 1 are fitted without the housings 3 so that the inside of the connector can be seen. One can see in FIG. 2 that the first blade 8 of one of the terminals 1 is fitted between the first blade 8 and the second blade 9 of the other of the terminals 1, and vice-versa. Thus, the projection 11 of the first blade 8 is fitted into the opening 10 of the other of the first blades 8, and vice-versa. In the Figure, the openings 10 and the projections 11 cannot be seen, however, the Figure clearly shows that each of the terminals 1 making up the connector has a male and female arrangement simultaneously.

Figure 3:
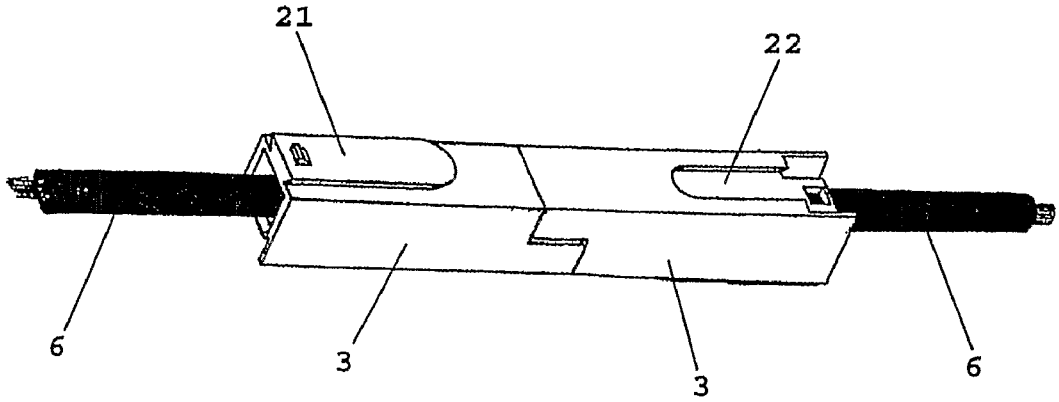
FIG. 3 is a view of the connector of FIG. 1, with the housings.

FIG. 3 shows the connector fully assembled, ready for use, wherein only the electric cable 6 and the two housings 3 are seen, which are fitted as indicated by arrows 16 in FIG. 1. One can see a protuberance 21 on the housing 3 on the left and a recess 22 on the housing 3 on the right. The protuberance 21 and the recess 22 may be fitted together and thus allow a plurality of the terminals 1 to be laterally joined together, according to the user's needs, so as to form terminal modules. The housings 3 and connecting portions 2 are identical. The differences shown in FIGS. 2 and 3 are due to the fact that the housings 3 and the connecting portions 2 are inverted by 180 degrees, in relation to one another, so that they can be connected to form the connector.

Figure 4:
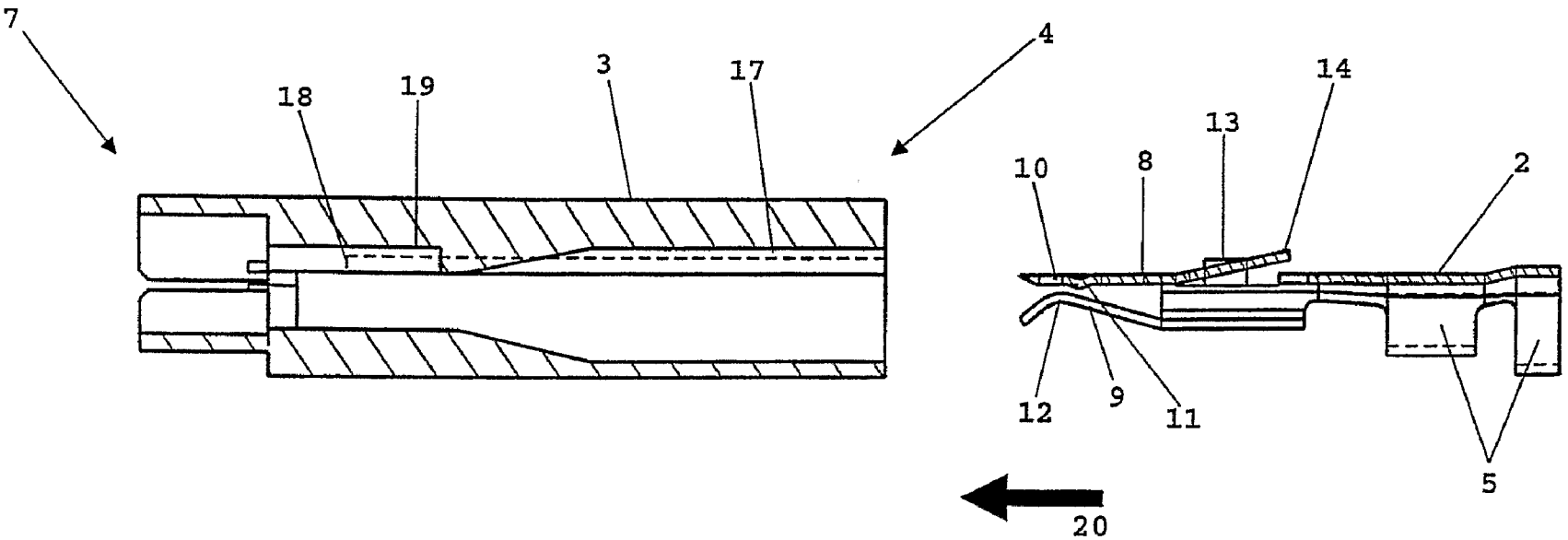
FIG. 4 is a longitudinal section of the housing and the connecting portion shown in FIG. 1.

FIG. 4 shows a longitudinal section of housing 3 and the connecting portions 2 shown in FIG. 1, wherein the connecting portions 2 can be inserted into the housing 3 through the first end 4, as indicated by arrow 20. Upon the insertion for the mounting of terminal 1, the guides 13 slide along guide members 17 until they reach an end 18 of the guide members 17. The end 18 acts as a stop for preventing the connecting portion 2 from coming out of the housing 3 through the second end 7. At the same time, the tongue 14 is received into the recess 19 to lock the connecting portion 2 onto the housing 3, thus completing the terminal assembly according to the invention. One can also see in the Figure that the electric cable 6 is not mounted in the terminal 1 and that the connecting member 5 of the electric cable 6 is open. Upon mounting the electric cable 6, the connecting member 5 is pressed onto the electric cable 6, as shown in FIGS. 1 and 2. The Figure also shows, in further detail, the opening 10 and the projection 11 of the first blade 8, as well as the inclined portion 12 of the second blade 9.

In addition to the embodiments previously presented, the same inventive concept may be applied to other alternatives or possibilities of using the invention. For example, in a second embodiment of the connector according to the invention, the first blade 8 may be completely smooth, without the opening 10 and the recess 19. In this case, the fitting between the two terminals 1 of the connector may be achieved merely by pressing the second blades 9 or by a locking arrangement in both the housings 3 at the second end 7 of the terminals 1. This locking arrangement may be, for example, a helical rib or a number of parallel ribs. It will be thus appreciated that the present invention is to be construed in a broad way, its scope being determined by the terms in the appended claims.

What is claimed is:

1. A terminal for a connector, comprising:

a housing having a top and a bottom, the top having a recess and the bottom having a protuberance, the recess being configured to receive a protuberance from another housing when in a stacked arrangement below the other housing, the protuberance being configured to be received in a recess of another housing when in a stacked arrangement above the other housing; and a connecting portion arranged in the housing, the connecting portion having a first end provided with a connecting member for connection of an electrical cable and a second end provided with a first blade and second blade arranged side by side, the first blade having a fitting arrangement and the second blade having a spring arrangement.

2. The terminal of claim 1, wherein the fitting arrangement includes an opening through the first blade and a projection.

3. The terminal of claim 1, wherein the second blade is divided into at least two legs.

4. The terminal of claim 1, wherein the spring arrangement includes an inclined portion.

5. The terminal of claim 1, wherein the connecting portion includes guides corresponding to guide members in the housing and a tongue that engages the housing to lock the connecting portion in the housing.

6. The terminal of claim 1, wherein the housing includes a sliding arrangement formed at an end of the housing that houses the first blade and the second blade.

7. The terminal of claim 1, wherein the housing is a one piece body completely surrounding the connecting portion along an axis of the connecting portion.

8. The terminal of claim 1, wherein the housing includes a latching feature associated with the recess and with the protuberance, the latching features being configured to secure the housing in the stacked arrangement.

9. The terminal of claim 1, wherein the connecting portion is plugged into an end of the housing along a longitudinal axis of the housing, the connecting portion including a tongue extending outward therefrom, the tongue locking the connecting portion into the housing while the connecting portion is plugged into the housing.

10. The terminal of claim 1, wherein the recess and the protuberance are configured to resist relative movement between the housing and the other housing in the stacked arrangement.

11. A connector, comprising:

a pair of terminals, each of the terminals including a housing and a connecting portion, the connecting portion being arranged in the housing, the connecting portion having a first end provided with a connecting member for connection of an electrical cable and a second end provided with a first blade and second blade arranged side by side, the first blade having a fitting arrangement and the second blade having a spring arrangement; and the fitting arrangements of the first blades of the terminals being engaged to mate the terminals; and the housings include tops and bottoms, each of the tops having a recess and each of the bottoms having a protuberance, the recess being configured to receive a protuberance from another housing when in a stacked arrangement below the other housing, the protuberance being configured to be received in a recess of another housing when in a stacked arrangement above the other housing.

12. The connector of claim 11, wherein the fitting arrangement includes an opening through the first blade and a projection.

13. The connector of claim 11, wherein the second blade is divided into at least two legs.

14. The connector of claim 11, wherein the spring arrangement includes an inclined portion.

15. The connector of claim 11, wherein the connecting portion includes guides corresponding to guide members in the housing and a tongue that engages the housing to lock the connecting portion in the housing.

16. The connector of claim 11, wherein the housing includes a sliding arrangement formed an end of the housing that houses the first blade and the second blade, the sliding arrangement of the terminals being engaged to mate the terminals.

17. The connector of claim 11, wherein the engagement between the fitting arrangements of the first blades of the terminals provides the majority of the mechanical engagement between the terminals.

18. The connector of claim 11, wherein the housing includes a latching feature associated with the recess and with the protuberance, the latching features being configured to secure the housing in the stacked arrangement.

19. The connector of claim 11, wherein the connecting portions are plugged into ends of the corresponding housings along longitudinal axes of the housings, the connecting portions each including a tongue extending outward therefrom, the tongue locking the connecting portion into the corresponding housing while the connecting portion is plugged into the housing.

20. The connector of claim 11, wherein the recess and the protuberance are configured to resist relative movement between the housing and the other housing in the stacked arrangement.

* * * * *